United States Patent [19]

Daughters

[11] 4,369,884

[45] Jan. 25, 1983

[54] INK RIBBON CARTRIDGE PACK

[76] Inventor: James R. Daughters, 244 Morris Ranch Rd., Danville, Calif. 94526

[21] Appl. No.: 284,430

[22] Filed: Jul. 20, 1981

Related U.S. Application Data

[63] Continuation-in-part of Ser. No. 80,880, Oct. 1, 1979, Pat. No. 4,307,969.

[51] Int. Cl.[3] ..... B65D 85/67; B65D 1/40; B41J 35/28

[52] U.S. Cl. ..... 206/389; 206/393; 206/403; 206/408; 206/521; 206/585

[58] Field of Search ..... 206/387, 398, 463, 564, 206/821, 586, 585, 389, 391, 393, 396, 397, 404, 405, 406, 408, 53; 225/51

[56] References Cited

U.S. PATENT DOCUMENTS

| | | | |
|---|---|---|---|
| D. 226,146 | 1/1973 | Price | 206/387 X |
| 3,612,233 | 10/1971 | Nagpal et al. | 206/387 X |
| 3,620,367 | 11/1971 | Stembel | 206/387 |
| 3,913,737 | 10/1975 | Tucker | 206/408 |
| 4,120,398 | 10/1978 | Braddon, Sr. | 206/408 |
| 4,159,756 | 7/1979 | Manis et al. | 206/396 |
| 4,234,092 | 11/1980 | Axel | 206/586 X |
| 4,307,969 | 12/1981 | Daughters | 400/208 |

*Primary Examiner*—William Price

*Assistant Examiner*—Brenda J. Ehrhardt

*Attorney, Agent, or Firm*—Townsend and Townsend

[57] ABSTRACT

A protective pack for holding a cartridge for a daisy wheel type printer is disclosed. The cartridge has a supply spool for holding a fresh ribbon pancake and a take-up spool for holding used ribbon. The cartridge body has a viewport extending radially adjacent the ribbon pancake to allow observation thereof. The cartridge includes two arms which define a path for the ribbon to pass between the paper and the printer mechanism. Two drive gears are serially engaged with each other and with the ribbon drive means. When the first drive wheel is driven by a drive shaft of the printer, the second acts as an idler gear so that the direction of ribbon take-up is the same as the direction of the rotation of the drive shaft. When the second gear is driven, it drives the ribbon drive gear means directly so that the rotational direction of the ribbon take-up is opposite that of the drive shaft. The drive gears are located and their lower portions are configured to engage the respective drive shafts of various printers. The ribbon pack is an open shell having a cavity shaped to conform to the cartridge body. A shoulder projecting upward in the cavity inserts into the viewport when the cartridge is placed therein to prevent the ribbon pancake from telescoping during shipment.

8 Claims, 9 Drawing Figures

INK RIBBON CARTRIDGE PACK

This is a continuation-in-part of pending prior application Ser. No. 80,800, now U.S. Pat. No. 4,307,969, filed on Oct. 1, 1979 of James R. Daughters for UNIVERSAL RIBBON CARTRIDGE.

This invention relates to generally printer cartridges, and more particularly to protective packings for such cartridges during shipment.

SUMMARY OF THE PRIOR ART

High speed printers of the daisy wheel type are known. In such printers a wheel with a protruding group of petals—typically one for each character—is provided. While operating at speeds well beyond human visual discrimination, the printer sequentially registers a wheel petal with a character to be printed thereon over a position on a piece of paper. Once registered, a hammer strikes a petal. Upon striking, the petal moves forward onto the ribbon, leaving an indicia of the desired letter on the paper to be printed.

These daisy wheel type printers commonly employ ribbon cartridges in their design. Such ribbon cartridges have a supply spool with a supply of fresh ribbon on it. They also have a take-up spool for winding the used ribbon around. The cartridge has two arms. The ends of the arms define a path along which the ribbon passes as it is wound onto the take-up spool. A drive shaft from the printer engages the bottom portion of a drive gear. The drive gear has a complementarily-shaped recess for engagement with the driving head of the drive shaft. The drive gear rotates a typically serrated drive wheel. The ribbon passes between the drive wheel and a biased idler wheel and is thereby advanced along the path between the daisy wheel printer and the paper. The take-up spool is typically rotated by an external drive band, such band being driven by an extension of the drive wheel.

Such printers, while having common printing mechanisms, have surprisingly varied mechanisms for holding the cartridge in place and driving the ribbon. For example, in one common type of cartridge, the cartridge is grasped at the sides with pegs registered to apertures in the printer. Exemplary of such a cartridge are those cartridges which fit the printer known as the Diablo II, a product of the Diablo Systems Division of the Xerox Corporation.

Another type of printer includes a mechanism whereby a second type of cartridge is grasped between the extended tape exit and tape entrance arms.

In both of the above type cartridges, driving is provided by driving shafts having driving heads which protrude into the cartridge at differing locations. Moreover, the driving shaft turns in a first direction in one printer and a second direction in the other printer.

It will be remembered that the cartridges are of the replaceable variety. They are typically consumed at the rate of one cartridge per working shift. This being the case, the cartridges are consumed on a volume basis.

Even though the printers and printer applications are highly similar, suppliers of such ribbons must provide different cartridges for different machines. Inventory problems can result because of the number of types of cartridges which must be supplied. Moreover, confusion as to the required supply of each type may also arise.

A problem commonly encountered by all such ribbon cartridges is the tendency of the ribbon to pancake (i.e., the ribbon wound around the supply spool) therein to deform or "telescope" about the supply spool. Such telescoping frequently occurs while the cartridge is being shipped from the manufacturer to the user and often results in malfunctioning of the cartridge when placed in a printer. It is known to place cardboard inserts through a viewport formed in the cartridge and aligned with the ribbon pancake to prevent such telescoping. This approach has proven inadequate, however, since the cardboard insert often becomes dislodged during shipment.

An additional problem encountered with ribbon cartridges of this type is damage to the internal working parts resulting from jarring occurring during shipment and handling. It is thus desirable to provide an individual pack for the cartridges which will prevent jarring and insulate the cartridges from shock.

SUMMARY OF THE INVENTION

A cartridge for accommodating a daisy wheel type printer is disclosed. The cartridge is the type which contains two spools. One spool (the supply spool) has wound about it a fresh supply of typing or printing ribbon. The other spool (the take-up spool) is used to wrap the used ribbon on. The spools are encased in a body which includes an elongate viewing port so that the amount of fresh ribbon on the supply spool may be ascertained.

The present invention overcomes the problem of the supply ribbon pancake telescoping from the supply spool and jamming the ribbon feed mechanism in the cartridge. This is accomplished by providing a specially adapted individual pack for the cartridge which holds the supply ribbon pancake in place during shipment to the user. The pack is an open shell formed about the cartridge case to hold it in place. The interior of the shell includes a raised shoulder having dimensions complementary to that of the viewing port so that when the cartridge is placed in the shell, the shoulder will project through the viewing port and engage the supply ribbon pancake. By thus engaging the ribbon pancake, the pancake is held in place and cannot telescope from the spool.

The packs are also adapted to cushion the individual cartridges when multiple cartridges are placed together in a shipping box. In the presently preferred embodiment, each pack includes a flange or lip around the edge, which flange is shaped to conform to the sides of a shipping carton designed to hold a plurality of cartridges. The cartridge packs (each holding a cartridge) are placed in the carton, with the open faces of the packs adjacent each other to hold the cartridges inside. The only part of the pack touching the carton is the outer edge of the flange. In this way, the flanges act as cushions to protect the cartridges from rough treatment. Additionally, a second shoulder projects outward (i.e., away from the interior holding the cartridge) from the pack to provide cushioning between adjacent cartridge pairs.

DETAILED DESCRIPTION OF THE PREFERRED EMBODIMENT

Figure 1:
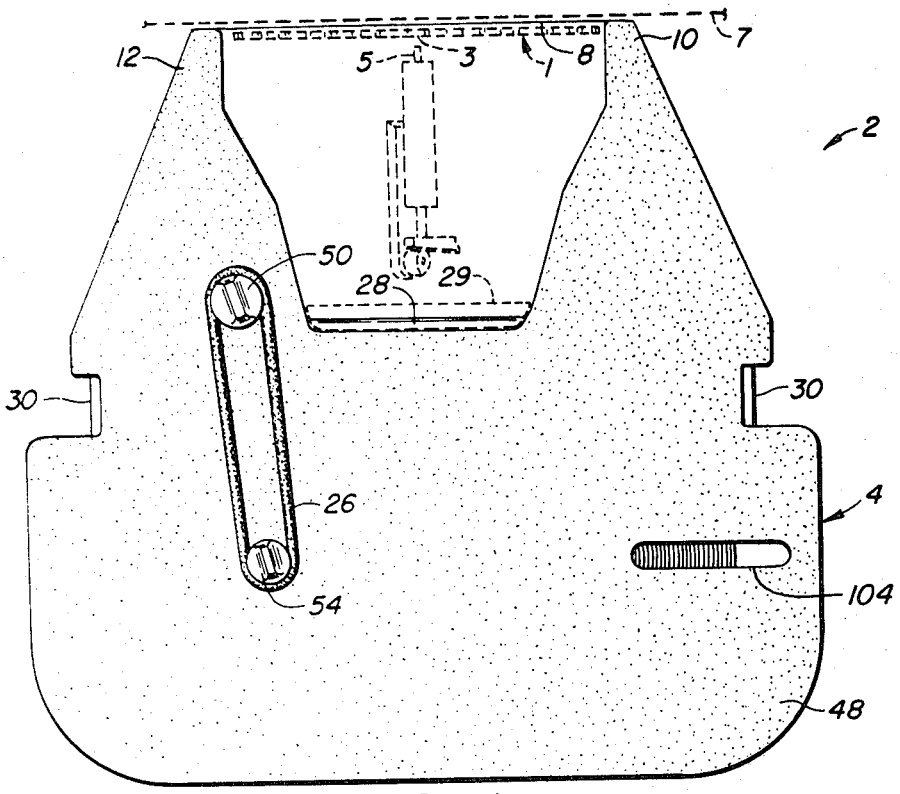
FIG. 1 is a top or plan view of the invention with a daisy wheel printer schematically shown.

A typical daisy wheel printer, the type with which the invention is generally used, will be described first to enable the reader to better understand the invention. Turning now to FIG. 1, universal ribbon cartridge 2 is shown together with a daisy wheel 1, a petal 3, a hammer 5, and paper 7. Daisy wheel 1, a thin, radially segmented disk-shaped element, carries the characters to be printed on the outermost ends of petals 3 of daisy wheel 1. When a character impression is to be imparted to paper 7, daisy wheel 1 is rotatably indexed at a high rate of speed. Hammer 5 is then activated and strikes the proper petal 3 of daisy wheel 1. The struck petal 3 is driven forward against a ribbon 8 to leave its particular impression on paper 7. The entire printing mechanism including cartridges 2 (and ribbon 8 therewith), wheel 1 and hammer 5 are then indexed for the next impression. Additionally, ribbon 8 is indexed to provide fresh ribbon 8 for the next impression.

Figure 2:
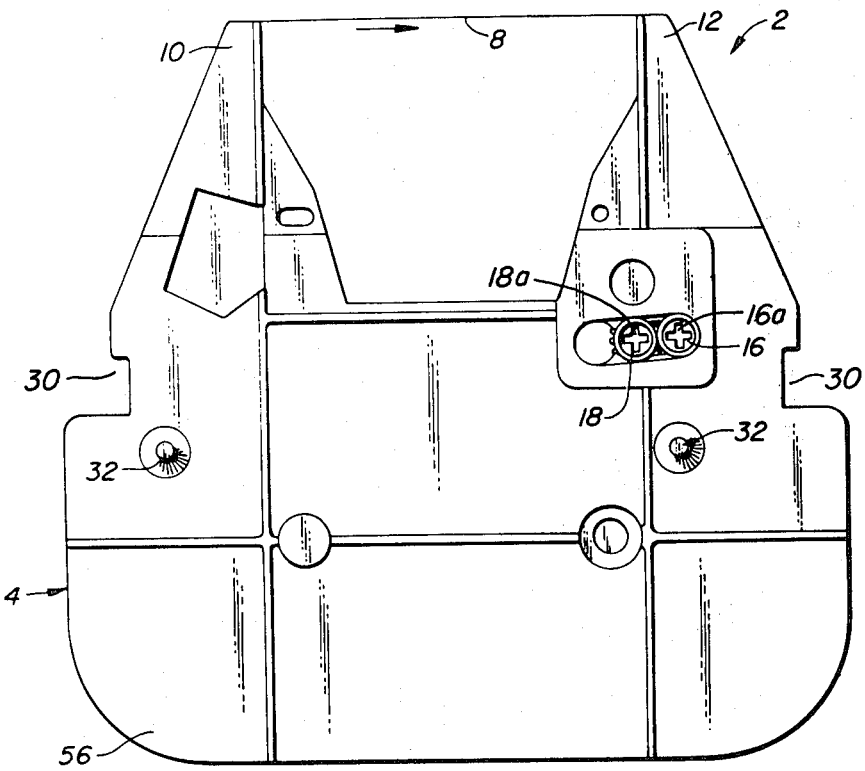
FIG. 2 is a bottom view of the invention.
Figure 3:
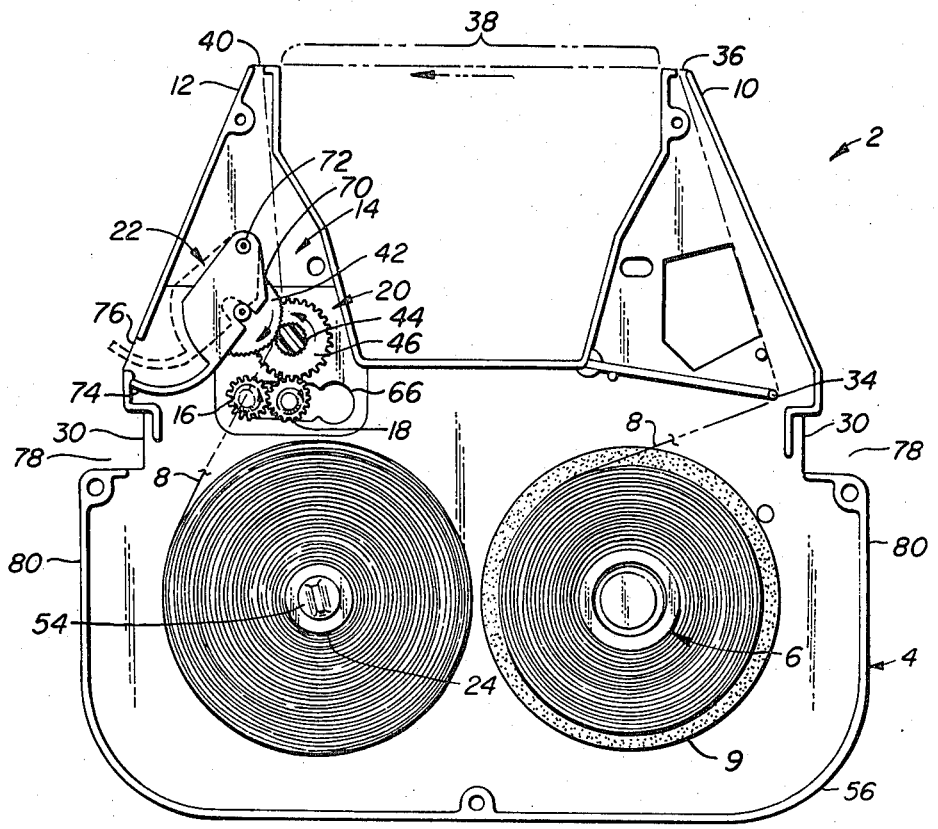
FIG. 3 is a top view of the invention with the top half of the body removed.

As can be seen from FIGS. 1–3, the universal ribbon cartridge 2 has a body 4, a supply spool 6 on which the ribbon 8 is wound, a ribbon exit arm 10, a ribbon entry arm 12, and a ribbon take-up means 14. Take-up means 14 includes first and second drive gears 16, 18, a ribbon drive means 20, an idler wheel assembly 22, a take-up spool 24 and an external drive band 26. A gripping surface 28, a mounting means 30, and removable pegs 32 allow the cartridge to be mounted on different printers. FIG. 1 shows the gripping means 29 of the printer engaging surface 28 thereby securing cartridge 2 to the printer.

Turning to FIG. 3, supply spool 6 is mounted to body 4. Typically a piece of foam 9 is placed between supply spool 6 and body 4 to provide a drag on spool 6 so a proper tension is maintained on ribbon 8. Ribbon 8 wends its way past a first point 34 and then through an exit opening 36 at the end of exit arm 10. Ribbon 8 passes along a path 38 defined between exit and entry arms 10, 12 and re-enters body 4 through an entrance opening 40 formed at the end of entrance arm 12.

Figure 4:
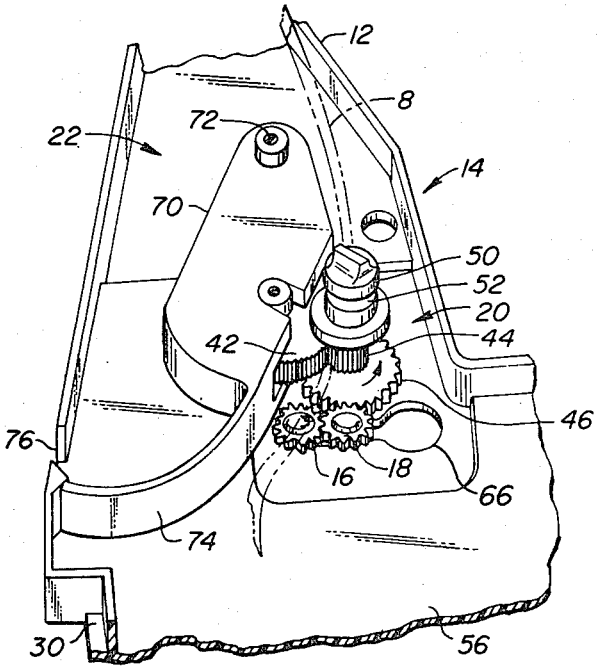
FIG. 4 is a detailed view of the ribbon gathering means and the first and second drive gears.

As shown best at FIG. 4 in conjunction with FIGS. 1 and 3, ribbon 8 is driven along its path by passing between the serrated surfaces of idler wheel 42 and ribbon drive wheel 44. Wheel 44 is mounted on a common shaft with a ribbon drive gear 46. Ribbon drive wheel 44 and ribbon drive gear 46 comprise ribbon drive means 20. Gear 46 rotatably engages and is driven by second drive gear 18.

Also mounted on a common shaft with ribbon drive gear 46 and extending outwardly past a top half 48 of body 4 is an extension 50 defining a circular groove 52 into which drive band 26 is seated. Band 26 also seats within a like extension 54 extending from take-up spool 24. Rotation of drive wheel 44 thus results in the rotation of spool 24. As the amount of ribbon 8 on spool 24 increases, band 26 slips so that the travel of ribbon 8 along path 38 is determined by the rotational speed of serrated wheel 44 and not by the rotational speed of take-up spool 24.

Figure 5:
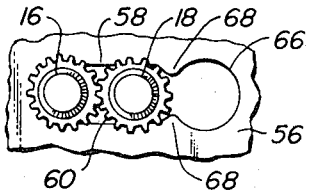
FIG. 5 is a view of the first and second driving gears mounted within an elongate hole in the bottom half of the body as seen from the inside of the cartridge.

As seen best at FIGS. 2, 4 and 5, first and second drive gears 16, 18 are mounted on a bottom half 56 of body 4 with second gear 18 serially engaging both first gear 16 and drive gear 46. Gears 16, 18 are located to overlay respective ribbon drive shafts from differing types of printers. Gears 16, 18 have complementarily-shaped recesses 16*a*, 18*a*, respectively for positive rotational engagement with their respective ribbon drive shafts, as seen at FIG. 2. In the preferred embodiment gears 16 and 18 are of the same size; however, depending upon the particular requirements of the printer used, gears 16, 18 may be of differing sizes. Also, in the preferred embodiment the serial alignment of gears 16, 18 allows the universal ribbon cartridges 2 to be used on printers with printer drives which rotate in opposite directions. This advantage exists because when first drive gear 16 is driven by the driving head of the the printer drive shaft, second drive gear 18 acts as a direction reverser so that ribbon drive gear 46 turns in the same direction as the printer drive shaft. When the driving head of the printer drive shaft engages and drives the second drive gear 18, ribbon drive gear 46 turns in the opposite direction as the printer drive shaft.

Figure 6:
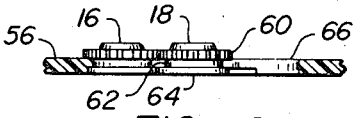
FIG. 6 is a cross-sectional view of the first and second driving gears shown in FIG. 5.

Turning now to FIGS. 5 and 6, drive gears 16, 18 are mounted on bottom half 56 in a convenient manner. An elongate hole 58 having semi-circular ends is formed in bottom half 56. Gears 16, 18 are relatively thin, cylindrical elements having teeth 60 around the circumference of one end, a groove 62 defined medially within the circumference of gears 16, 18, and a retaining shoulder 64 defining the circumference of the other end. The entry end 66 of hole 58 is slightly larger than the remaining portion thereby allowing shoulder 64 to be passed therethrough but not so large as to allow teeth 60 to pass therethrough. Gear 16 is then slid along hole 58 past detents 68. Gear 18 is likewise positioned in hole 58 and engages gear 16. Some slight pressure is necessary to get gears 16, 18 past detents 68. Gears 16, 18 are retained in position by the engagement of the sides of hole 58 with groove 62 and by detents 68.

Idler wheel assembly 22, as shown in FIGS. 3 and 4, includes an idler wheel carrying arm 70 pivotally connected to body 4 at a pivot point 72 at one end thereof. Idler wheel 42 is rotatably connected to arm 70 at a central portion of arm 70. At the end opposite pivot point 72, arm 70 includes a flat spring 74 extending outwardly therefrom. Spring 74 is configured to rest against an inside surface of body 4 at a point near an aperture 76 thereby biasing idler wheel 42 against ribbon drive wheel 44. During assembly spring 74 extends through aperture 76 so that no force is exerted by idler wheel 42 on ribbon drive wheel 44. After assembly with top and bottom halves 48, 56 of body 4 secured, spring 74 is urged inwardly through aperture 76, thus biasing idler wheel 42 against ribbon drive wheel 44. Using this method, lateral forces on pivot point 72 and ribbon drive wheel and gear 44, 46 are greatly reduced thus promoting alignment of components and easing assembly considerably.

Figure 7:
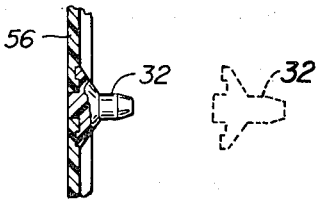
FIG. 7 is a cross-sectional view of a removable peg.

The preferred embodiment of universal ribbon cartridge 2 is adapted for mounting on at least two types or classes of printers. A first type engages cartridge 2 at gripping surface 28, shown at FIG. 1, which surface 28 is defined along the edge of top half 48 of body 4 between arms 10, 12. A second type grips bottom half 56 at gripping means 30, shown at FIG. 3. Means 30 is a narrow planar extension located within a notch 78 medially along both sides 80. Cartridge 2 also has removable pegs 32, as seen at FIGS. 2 and 7, positioned within bottom half 56 for registry with corresponding apertures in the second type printer. Other means, such as pivotable pegs, not shown, could also be used in lieu of the removable pegs 32.

In the preferred embodiment all elements, except drive band 26 and ribbon 8, are made of plastic, however other suitable materials can be used. Spring 74 could, for example, be made of phosphor bronze as well as nylon.

Figure 8:
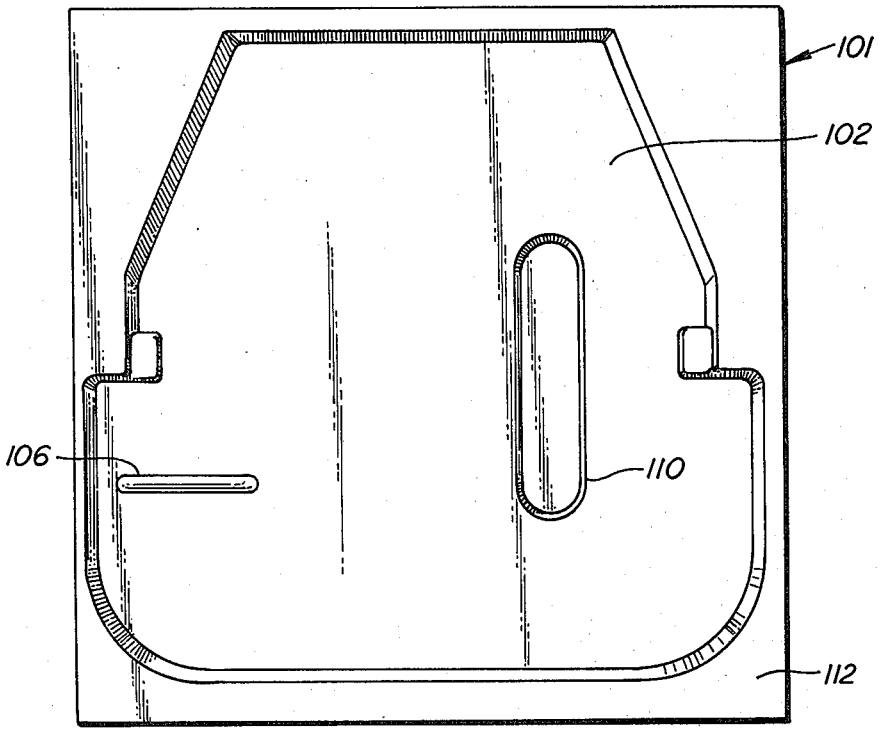
FIG. 8 is an elevational view illustrating the interior of the packing shell of the present invention.
Figure 9:
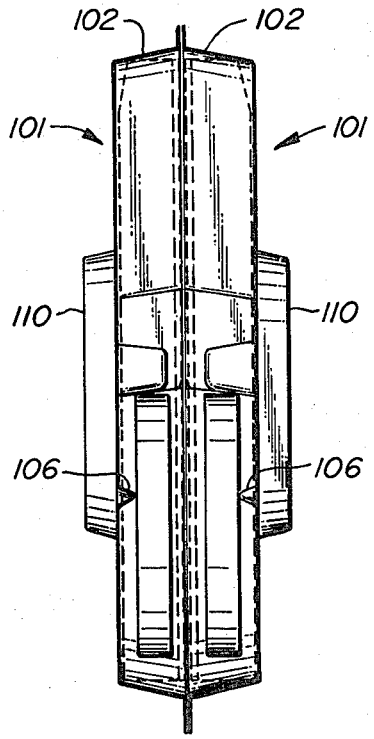
FIG. 9 is a cross-sectional view of two packing shells of the present invention including two ribbon cartridges therebetween.

Referring now to FIGS. 8 and 9, a protective shell 101 for use in shipping the ribbon cartridge 2 of the present invention is illustrated. The shell 101 is molded from a sheet of light plastic and has a depression 102 formed therein which corresponds to the external shape of the ribbon cartridge 2. The ribbon cartridge 2 includes a viewport 104 (FIG. 1) in the body 4 which allows the viewer to see the amount of ribbon 8 remaining on the supply spool 6. The packing case 101 has a shoulder 106 formed therein and projecting upward (toward the interior of the depression 102). The length and width of the shoulder 106 are chosen to correspond to the dimensions of the viewing port 104 and, thus, when the cartridge is inserted in the protective shell 101, the shoulder 106 will project through the viewing port 104 and into the interior of the cartridge 2. The depth of penetration of the shoulder 106 is chosen so that it will firmly engage the supply ribbon pancake and prevent the ribbon pancake from telescoping from the spool.

To complete the packing of cartridges 2 for shipment, pairs of cartridges 2 placed in individual shells 101 are placed face-to-face so that the exposed faces of the cartridges lie adjacent one another, as illustrated in FIG. 9. A plurality of pairs of cartridges 2 thus packed may be placed in cardboard containers for shipment to the user. It is preferred that the individual shells 101 include a second shoulder 110 which projects outward, that is, in the direction away from the interior of the depression 102. Thus, when the pairs of cartridges are packed in a cardboard container, the shoulders 110 provide some spacing between the packs and allow for shock absorption during any rough treatment the package may receive during shipment. Additional cushioning is provided the flange 112 defined by the remaining portion of the initial sheet of plastic. The dimensions and shape of the flange are chosen to conform to the interior of the shipping container and, thus, are the only part of the pack which touch the container. The resiliency of the flange provides the additional cushioning.

Thus, although the best mode contemplated for carrying out the present invention has been herein shown and described, it will be apparent that modification and variation may be made without departing from what is regarded to be the subject of the invention.

What is claimed is:

1. A protective pack for packing a plurality of ribbon cartridges inside a carton, each of said cartridges including a body, a ribbon pancake mounted within the body, said body having a viewport extending radially adjacent the ribbon pancake to allow observation thereof, the protective pack comprising a shell defining a cavity having a shape substantially conforming to that of the cartridge and a shoulder projecting from the shell into the cavity, the shoulder having dimensions and being located so that it will project through the viewport and engage the ribbon pancake when the cartridge is placed in the pack.

2. A double protective pack for a pair of ribbon cartridges each of which includes a body, and a ribbon pancake mounted within the body, where said body has a viewport through one side thereof which extends radially along the ribbon pancake to allow observation thereof, the pack comprising a pair of shells, each shell having substantially the same dimensions and defining a cavity having a shape substantially conforming to that of the cartridge and each shell including a shoulder projecting into the cavity and disposed so that it will project through the viewport of the cartridge packed therein, the double pack being formed by placing the two shells adjacent one another so that the open faces of the cavities are closed by the opposing shell.

3. A protective pack, as in claim 1 or 2, wherein said pack is formed from a resilient plastic material.

4. A protective pack, as in claim 1 or 2, wherein said shell further includes a flange extending about its edge and shaped to conform to the interior of the carton.

5. A protective pack, as in claim 1 or 2, wherein said shell further includes a second shoulder projecting from the shell in a direction away from the cavity, said second shoulder having dimensions and being located so that it will engage an adjacent pack in the carton to provide a cushion there between.

6. A combination comprising a ribbon cartridge secured inside a protective pack, said ribbon cartridge including a cartridge body, a ribbon pancake mounted within the body, said body having a viewpoint extending radially adjacent the ribbon pancake to allow observation thereof, the protective back including a shell defining a cavity having a shape substantially conforming to that of the cartridge body and a shoulder projecting from the shell into the cavity, the combination being formed by inserting the cartridge into the pack in such a manner that the shoulder projects through the viewport and engages the ribbon pancake.

7. A carton of ribbon cartridges, said carton comprising a plurality of combinations as in claim 6 placed in the interior of a carton.

8. A carton as in claim 7, wherein the combinations are arranged alternately so that the open face of one protective pack always faces the open face of the adjacent protective pack.

* * * * *